United States Patent [19]

Smith et al.

[11] 3,955,704

[45] May 11, 1976

[54] STORAGE DEVICE

[75] Inventors: Victor George Smith, Peterlee; Albert Sjollema, Fence Houses, both of England

[73] Assignee: Clearex Plastics Ltd., Haughton-le-Spring, England

[22] Filed: July 19, 1973

[21] Appl. No.: 380,712

[30] Foreign Application Priority Data

July 20, 1972 United Kingdom ..... 33887/72

[52] U.S. Cl. ..... 220/21; 206/433; 206/523; 217/25.5; 217/27

[51] Int. Cl.[2] ..... B65D 1/24; B65D 81/06; B65D 85/30

[58] Field of Search ..... 220/21, 238; 217/25.5, 217/27; 206/433, 523

[56] References Cited

UNITED STATES PATENTS

| | | | |
|---|---|---|---|
| 185,409 | 12/1876 | Smith | 217/25.5 |
| 3,146,929 | 9/1964 | Keim | 206/433 |
| 3,191,791 | 6/1965 | Jackson | 217/25.5 |
| 3,241,661 | 3/1966 | Zamzow | 206/523 |
| 3,286,834 | 12/1966 | English | 217/27 |
| 3,349,937 | 10/1967 | Duff | 217/25.5 |
| 3,734,336 | 5/1973 | Rankow | 220/9 F |

*Primary Examiner*—George E. Lowrance
*Attorney, Agent, or Firm*—Laurence, Stokes & Neilan

[57] ABSTRACT

An article storage device intended especially but not exclusively for use in storing the rotor assemblies of electric motors and comprising a block formed with a plurality of recesses each adapted to receive an article to be stored and each having a closed lower end and an open upper end wherein said open upper end has a larger cross-sectional area than said lower end.

1 Claim, 2 Drawing Figures

STORAGE DEVICE

This invention relates to a storage device which is specially (but not exclusively) intended for use in storing the rotor assemblies of electric motors, such assemblies commonly being of the kind which comprises a rotor shaft on which is mounted a commutator, armature and fan.

The object of the invention is to provide an improved form of storage device.

In accordance with the invention there is provided a storage device which comprises a block in which is formed a plurality of recesses each adapted to receive an article which is to be stored, each of said recesses having a closed lower end and an open upper end and being arranged so that said upper end of the recess has a larger cross-sectional area than the lower end thereof.

Preferably, said block is formed as a one-piece moulding in a resilient material such as, for example, a foamed synthetic resin material and conveniently the block may be of generally cuboidal configuration.

Figure 1:
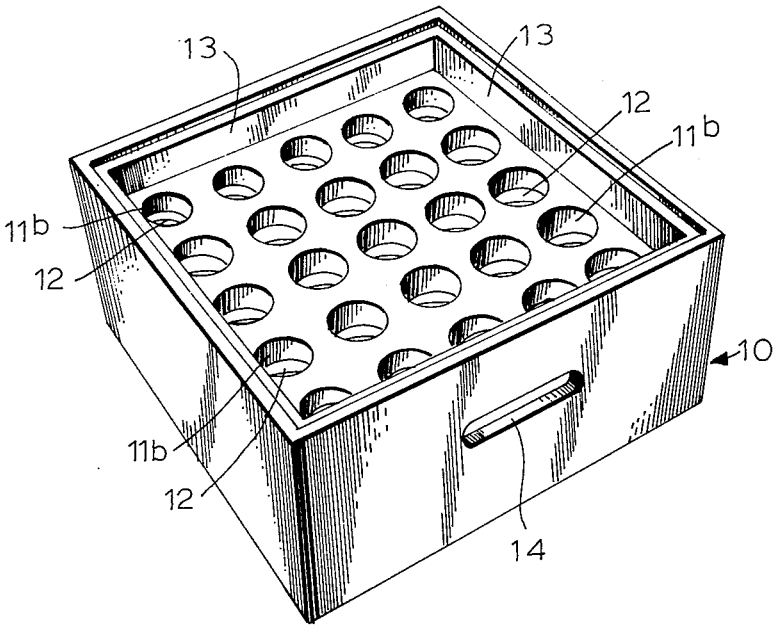
Figure 2:
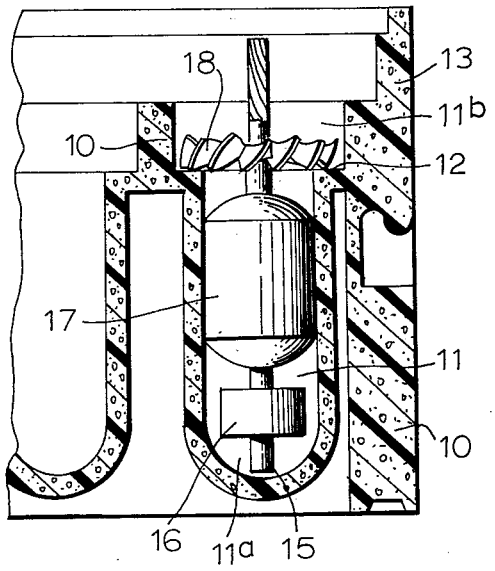

The invention will now be more particularly described with reference to and as shown in the accompanying drawings wherein, FIG. 1 is a perspective view of one example of a storage device constructed in accordance with the invention, and FIG. 2 is a part-sectional view, on a larger scale, of the device seen in FIG. 1, together with a rotor assembly of the kind which may be stored in the device.

Referring to the drawing, the storage device shown therein is intended for use in storing a plurality of rotor assemblies for electric motors although it is to be understood that a device in accordance with the invention can be used for storing other articles if desired. In the case of rotor assemblies however, such assemblies are commonly of the kind which comprises a rotor shaft on which is mounted a commutator, armature and fan.

The storage device now described comprises a block 10 which is conveniently formed as a one-piece moulding in a resilient material such as a foamed synthetic resin material (for example foamed urethane) although the block could be formed from other resilient materials or indeed from rigid materials if desired such as wood. The block is of generally cuboidal configuration and is formed in the moulding with a plurality of recesses 11 which are arranged so that when the block is in its operative, in use, position the lower end 11*a* of each recess is closed and the upper end 11*b* is open to receive one of the rotor assemblies as above described. Furthermore, said upper end 11*b* of each recess has a larger cross-sectional area than the lower end 11*a* but both ends are of generally cylindrical configuration so that an annular shoulder 12 is formed between the upper and lower ends of each recess.

The aforesaid recesses are conveniently arranged in a plurality of straight parallel lines (as seen in FIG. 1) and the four sides of the cuboidal block extend upwardly above the upper ends of said recesses as indicated by reference numeral 13. Furthermore, at least one pair of opposite sides of said block are each provided with a recess 14 (one of such recesses being seen in FIG. 1) formed in the moulding operation to serve as a hand hold whereby the device can be lifted and carried when desired. In use, the recesses 11 are adapted to receive a plurality of rotor assemblies each comprising a rotor shaft 15 on which is mounted a commutator 16, an armature 17 and a fan 18 as seen in FIG. 2. Conveniently each assembly is inserted so that the commutator 16 is lowermost, the adjacent end of the rotor shaft 15 then engaging the closed lower end 11*a* of a recess whereas the armature 17 will fit snugly into the lower part of the recess so as to protect said armature from any damage that might otherwise be caused if the armature were loosely mounted in the recess. The fan 18 of the rotor assembly would then be uppermost and since such fan usually has a larger diameter than the diameter of the armature, the fan itself would be located within the upper end 11*b* of the recess which, as previously described, is larger in diameter than the lower end of the recess. The arrangement is such however that the rotor assembly is securely positioned within the recess and since, in the example described the storage device is made from a foamed synthetic resin material, each rotor assembly can, if desired, be dropped gently into any vacant recess and will there be securely held and protected from any inadvertent damage until it is required to be used in assembling an electric motor.

We claim:

1. An article storage device comprising a one-piece moulding of a resilient material, said moulding having a plurality of recesses each adapted to receive an article to be stored therein, each of said recesses having an open upper end accessible from one end of the moulding and a closed lower end at the opposite end of said moulding, said upper ends and said lower ends being of generally cylindrical configuration, said upper ends being larger than said lower ends, an annular shoulder formed between the upper and lower ends of each recess, said moulding having a generally cuboidal configuration and shaped so that four sides thereof extend upwardly above the upper ends of said recesses, said one end having a planar surface containing the upper extremities of said upper ends of said recesses, the portions of said moulding forming said lower ends of said recesses being spaced from each other by void areas, said four sides of said moulding extending beyond the lower ends of said recesses, and said four sides being of greater thickness than said portions of said moulding forming said lower ends of said recesses.

* * * * *